United States Patent [19]

Schwörer

[11] Patent Number: 5,000,287

[45] Date of Patent: Mar. 19, 1991

[54] DISPLACEABLE PLATFORM MOVABLE SECTIONWISE ON A WALL

[75] Inventor: Artur Schwörer, Senden, Fed. Rep. of Germany

[73] Assignee: PERI GmbH, Weißenhorn, Fed. Rep. of Germany

[21] Appl. No.: 450,319

[22] Filed: Dec. 14, 1989

[30] Foreign Application Priority Data

Dec. 14, 1988 [DE] Fed. Rep. of Germany ..... 3842094

[51] Int. Cl.[5] ..... E04G 11/28; E04G 3/08; B66F 11/04

[52] U.S. Cl. ..... 182/82; 182/136

[58] Field of Search ..... 182/82, 141, 142, 136

[56] References Cited

U.S. PATENT DOCUMENTS

| | | | |
|---|---|---|---|
| 2,893,786 | 7/1959 | Faye | 182/82 |
| 3,106,989 | 1/1962 | Lindmark | 182/82 |
| 3,302,749 | 2/1967 | Heaphy | 182/82 |
| 3,830,338 | 8/1974 | Svensson | 182/82 |
| 3,881,699 | 5/1975 | Nusbaum | 182/82 |
| 4,060,358 | 11/1977 | Fougea | 182/82 |
| 4,611,784 | 9/1986 | Gallis | 182/82 |

FOREIGN PATENT DOCUMENTS

| | | |
|---|---|---|
| 870023 | 1/1953 | Fed. Rep. of Germany . |
| 3232411 | 3/1984 | Fed. Rep. of Germany . |
| 2314025 | 1/1985 | Fed. Rep. of Germany . |
| 2452182 | 5/1986 | Fed. Rep. of Germany . |

*Primary Examiner*—Reinaldo P. Machado
*Attorney, Agent, or Firm*—Townsend & Townsend

[57] ABSTRACT

A displaceable platform which can be advanced sectionwise on a wall has support shoes (11) which are securable to the wall (12) at specific intervals in the direction of advance, at least two carrier rails (13) which are arranged spaced apart alongside one another and which extend along the wall (12) between at least two support shoes (11) in each case, and at least one displaceable bracket arrangement (14) which is arranged for displacement in the direction of advance and is fixable on at least two adjacent carrier rails (13), with the carrier rail (13) and the displaceable bracket arrangement (14) being alternately displaced upwardly. A linear drive (15) is associated with each carrier rail (13) which advances the displaceable bracket arrangement (14), in the region of the associated carrier rail, in steps (S) which are so small in comparison to the length (L) of a section that non-uniform displacements of adjacent linear drives (15) by one step (S) can still be accommodated by the elasticity of the cooperating components. All linear drives (15) are driven and jointly controlled from a common drive and control apparatus (22), so that a further working step can first be introduced when all the linear drives (15) have completed the preceding working step.

20 Claims, 9 Drawing Sheets

Figure 1:
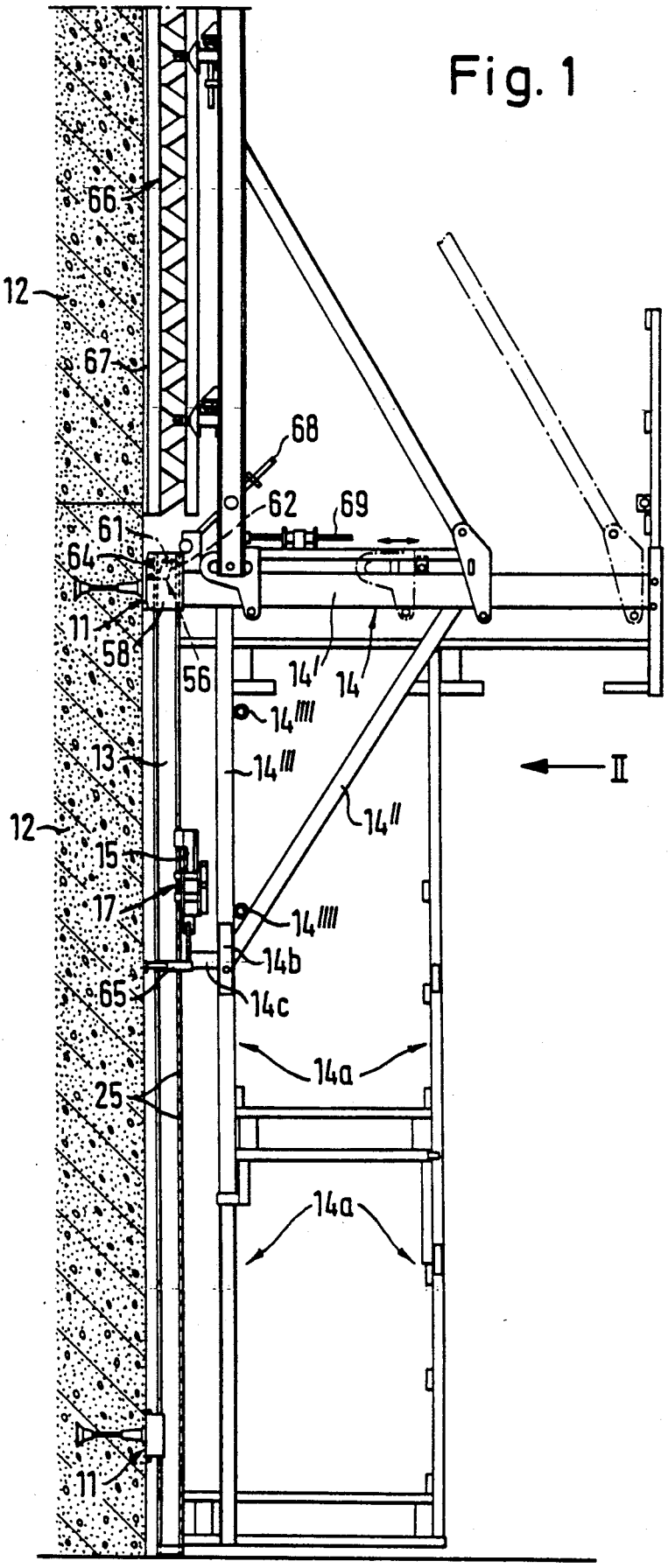

66
12
67
68
62
69
61
64
11
58
56
14'
14
14''''
13
14'''
II
14''
12
15
17
14''''
14b
65
14c
14a
25
14a
11

13''
87
24
13
25
37
39
43
41
41
17a
45
47
38
40
44
42
42
46
48
17b
49'
49
77
49''

DISPLACEABLE PLATFORM MOVABLE SECTIONWISE ON A WALL

The invention relates to a displaceable platform which is movable sectionwise on a wall, preferably upwardly, comprising support shoes which are securable to the wall at specific intervals in the direction of movement, at least two carrying rails which are arranged spaced apart alongside one another and which extend along the wall in each case between at least two support shoes, and at least one displaceable bracket arrangement which is displaceable in the direction of movement and is securably arranged on at least two carrier rails arranged alongside one another, wherein, the carrier rails are alternatively first fixed to the support shoes secured to the wall and the displaceable bracket arrangement is displaced by one section along the carrier rails by means of a linear drive, essentially from the one end of the carrier rails to the other end of the carrier rails, and is secured to the support shoes secured to the wall, and the carrier rails are thereupon released from the support shoes, are advanced by one section are then once again fixed to further support shoes secured to the wall, whereupon the sequence of working is repeated.

Such displaceable platforms are preferably those which are arranged on a building construction which has to be erected in concrete and which are components of climbing formwork or shuttering which, after concreting one portion of a wall of a construction, is lifted one section higher so that a further section of the wall can be concreted there. The essence of a displaceable platform of this kind lies in the fact that it has no direct connection to the ground during climbing and is merely secured by the support shoes to the section which is located beneath the section to be concreted and which has already been finish concreted. For each panel of the shuttering there are normally provided two carrier rails which are arranged spaced from one another. An embodiment with only one carrier rail at the center of the shuttering panel is however also basically possible.

The invention is thus primarily concerned with displaceable platforms for climbing formwork which can preferably be lifted upwardly through one concreting section at a time without outside help. Further applications for the displaceable platform of the invention are however basically conceivable. For example the displaceable platform can also be used with devices for the climbing of working scaffolds and protection scaffolds, of working stages, of platforms and the like. Furthermore, the invention can also be used with devices for the horizontal or upwardly inclined displacement of tunnel shuttering carriages, armouring carriages, movable wall shutterings, for example for support walls, or the like. Finally, the use of the invention can also be considered for devices for the horizontal upwardly directed or vertical displacement of heavy articles of all kinds, such as for example, segments of ships, transformers, etc. The use of the invention however primarily takes place in the shuttering and scaffold building field.

Shuttering and equipment is already known which cooperates with self-climbing devices in the manner of a displaceable platform of the same kind as the invention. They are above all used in the construction of bridge pillars or the building of power stations and cooling towers. Essentially one uses climbing frames, such as, for example, an automatic climbing unit or individual guide elements, in which synchronization with adjacent guides is either not necessary, due to the absence of large area shuttering elements, or can only be maintained by continuous observation and correction. Furthermore, known solutions for the climbing movement of large concreting section require either a plurality of expensive intermediate anchorages relative to the building, or they are very large and heavy in their external dimensions. Moreover, it is a disadvantage of the known displaceable platforms that different frame widths are required for elements of different widths and this leads to a large number of variants of the apparatus of differing heights and widths. With the larger variants a very high initial concreting section must first be produced with a seperate shuttering before the automatic climbing unit can be installed thereon.

The invention starts from a climbing displaceable platform such as is described in German patent No. 28 14 930.

The object underlying the invention is to provide a displaceable platform of the initially named kind, which is in particular intended for climbing on a construction which has to be concreted, wherein, with low technical complexity and expense, several units which are combined into a displaceable bracket arrangement can be simultaneously and reliably displaced in a robust manner which is particularly suited for operation on a building site, without non-uniform displacements at the different carrier rails leading to jamming or even to damage, wherein a failure of the advance at a specific carrier rail does not lead to damage, and wherein a climbing step can be carried out fully automatically without manual intervention.

In order to satisfy this object the invention provides a displaceable platform of the initially named kind which is characterized in that a linear drive is associated with each carrier rail and advances the displaceable bracket arrangement in the region of the associated carrier rails in steps which are so small compared to the length of a section that non-uniform displacements of adjacent linear drives through preferably one and at most a few, in particular two or three steps can still be tolerated by the elasticity and/or by the tolerances and/or by the relative play of the cooperating components; and in that all linear drives are jointly driven and controlled from a common drive and control apparatus in such a way that a further working step is first introduced when all linear drives have preferably completed the preceding working step or one of the preceding few working steps.

An advantageous further development of the invention is characterized by claim 2 wherein security against a further advance following non-secure latching of the toggle lever in accordance with claim 9 or claim 10 is expediently achieved by the measures of claim 16.

In accordance with the invention the problem of uniform upward travel of the displacement elements on the neighbouring carrying rails is solved in that the advance or stroke of the displaceable bracket arrangement is selected to be very small. Indeed this stroke is made so small that a problem at one of the carrier rails which prevents the further displacement of the displaceable bracket arrangement there only leads to a tolerable inclined position of the part of the displaceable bracket arrangement which extends between two adjacent carrier rails. This is achieved in accordance with the invention in that the next respective step or stroke is first initiated when all displacement elements which are connected to a common control device have reached the same level.

The invention can be realized in practice in a particularly advantageous manner by arrangements in accordance with claims 3 to 15.

A short hydraulic cylinder can advantageously serve as the linear drive, with the hydraulic cylinder being connected to the part to be displaced (displaceable bracket arrangement) and having guides with pivotally mounted levers at its cylinder housing and at its piston rod, with these guides being braced on the carrier rail and alternately bearing the load.

However, other linear drives such as for example spindle drives, climbing or belt drives, pneumatic cylinders, rack drives or electrical linear motors are also conceivable in place of the hydraulic cylinder.

The levers alternately engage, in similar manner to tree climbing irons, in the tooth recesses of a toothed displacement rack which are provided on one side at uniform intervals in the climbing rails. The integrated carrier spigot of each lever is pressed against the rail contour or rack by a resilient pull-back element (for example a spring cylinder), slides along the edge of a cutout, and finally along the outer contour in order to subsequently jump into the next recess and to be supported in this recess after reversal of movement of the drive. The reversal of movement first takes place when the moving lever has achieved its inclination corresponding to the later support position. The announcement to the drive control expediently takes place via proximity switches or electromagnetic end switches which are actuated by the levers and the signals of which can be supplied to a follow-up control. An additional security measure can be the linking of the lever end position indication to the drive end position indication (for example through pressure switches, proximity switches or the like). With the simultaneous use of several climbing units the reversal of movement first takes place after the end position indication for all displaceable elements.

The forces from the lever support are counteracted by the support forces and support moments of the oppositely disposed rail guides. It is however also conceivable to use a symmetrical double lever system which engages from both sides in toothed recesses at the rail.

The pushing on of the climbing rail into the next climbing section is made possible in a very simple manner by changing over the lever beyond the dead center position of the pull-back device. For this reason the toothed recesses are symmetrically constructed as seen transversely to the rail.

If the sequence of small climbing steps up to the end of the upper section is completed then the further displacement of the displacement element is automatically blocked in that the toothed displacement rack terminates at this position. A reversal of movement of the drive is reliably prevented as soon as the slide shoes reach the end of the toothed displacement rank. This applies both to the climbing movement of the displaceable bracket arrangement and also to the alternate pushing on of the carrier rails.

With the described design principle the carrier rails which can be manufactured at a relatively favourable cost are used in different lengths each matched to the height of the concrete section without changes being required to the remainder of the climbing device.

With hindrances to movement of any kind damage can be largely prevented in simple manner and indeed by the building in of pressure restricting valves into the hydraulic system, or by moment restricting devices in electromagnetic drives, such as clutches which are capable of slipping, switching clutches etc.

When using an elongate carrier section with a substantially H-shaped cross-section a direct connection can be realized between the displaceable bracket and the support shoe secured to the wall by engaging around the rail at both sides. The measures of claims 16 and 17 are preferably provided so that on pushing the upper end of the carrier rail through the upper support shoe the carrier rail automatically comes into a carrying engagement with this support shoe.

As a result of the construction of claim 18 it is ensured that the slidable guide shoe which is first held by the carrier rail in the horizontal direction on being pushed upwardly finally comes into a horizontally braced connection with the support shoe on being pushed upwardly, whereas the carrier rail subsequently passes out of the sliding engagement with the guide shoe for the purpose of subsequently being easily pushed upwardly.

As soon as the slidable guide shoe has again left the support shoe a repositioning of the horizontal support forces again takes place in the sense that the carrier rail once again supports the displaceable bracket while the rail in turn is held at the support shoe.

The geometrical construction of the upper and lower guides for the displaceable bracket arrangement is so selected that the latter cannot collide with the rail guide on passing a support shoe secured to the wall.

As a result of the minimization of the individual stroke or displacement steps the smallest dimensions and weights result, whereby a manual change over of the displacement or climbing mechanism from shuttering element to shuttering element is made substantially easier. As a result of the automated climbing sequence, which is largely free of safety risks, several adjacent, interconnected, displaceable bracket arrangements can also be operated even without visible contact. This is in particular of advantage when complete formwork and working stages climb tower-like constructions such as silos, communication towers, bridge pillars, etc.

A further advantage of the invention lies in the possibility of allowing the shuttering to climb downwards by simple manual actuation of the levers.

Figure 2:
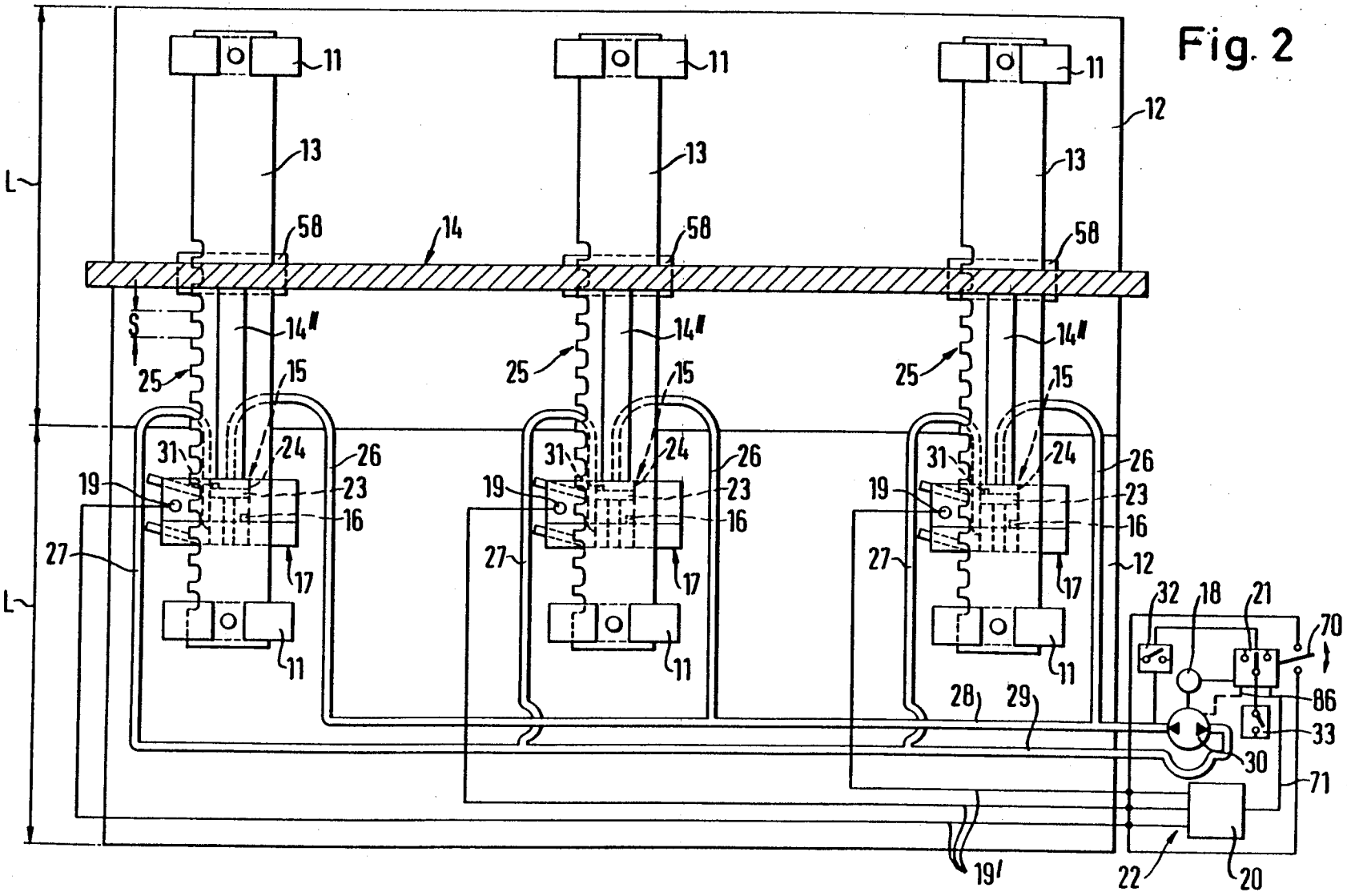
Figure 2A:
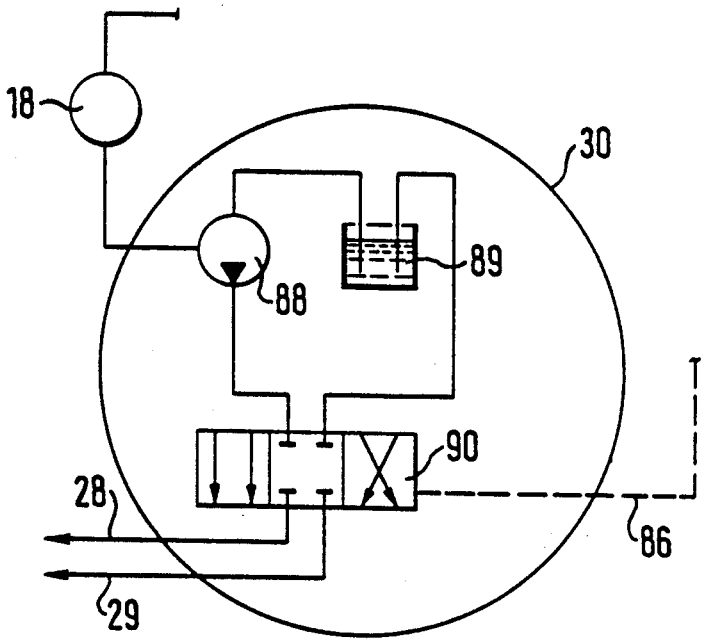
Figure 3:
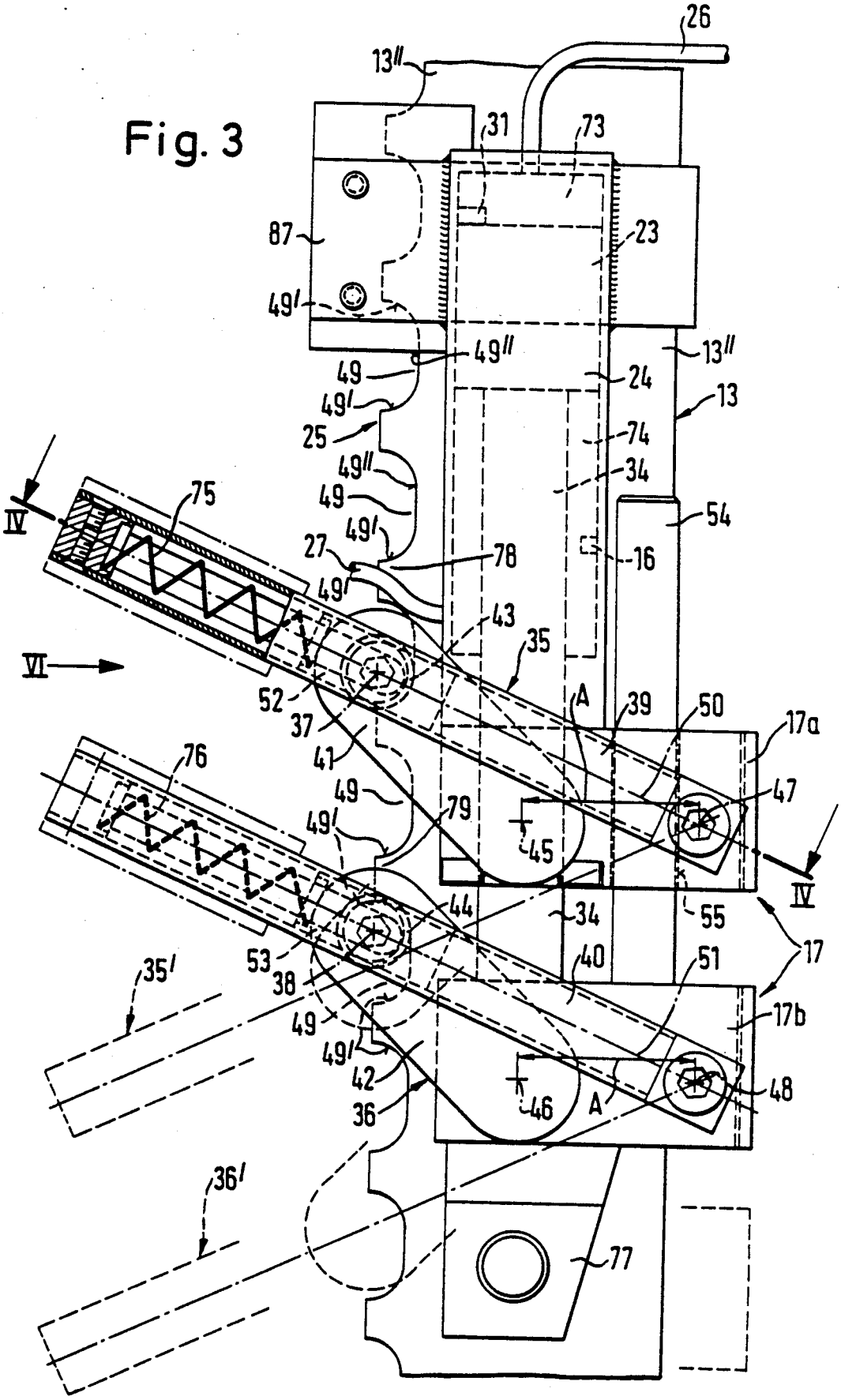
Figure 4:
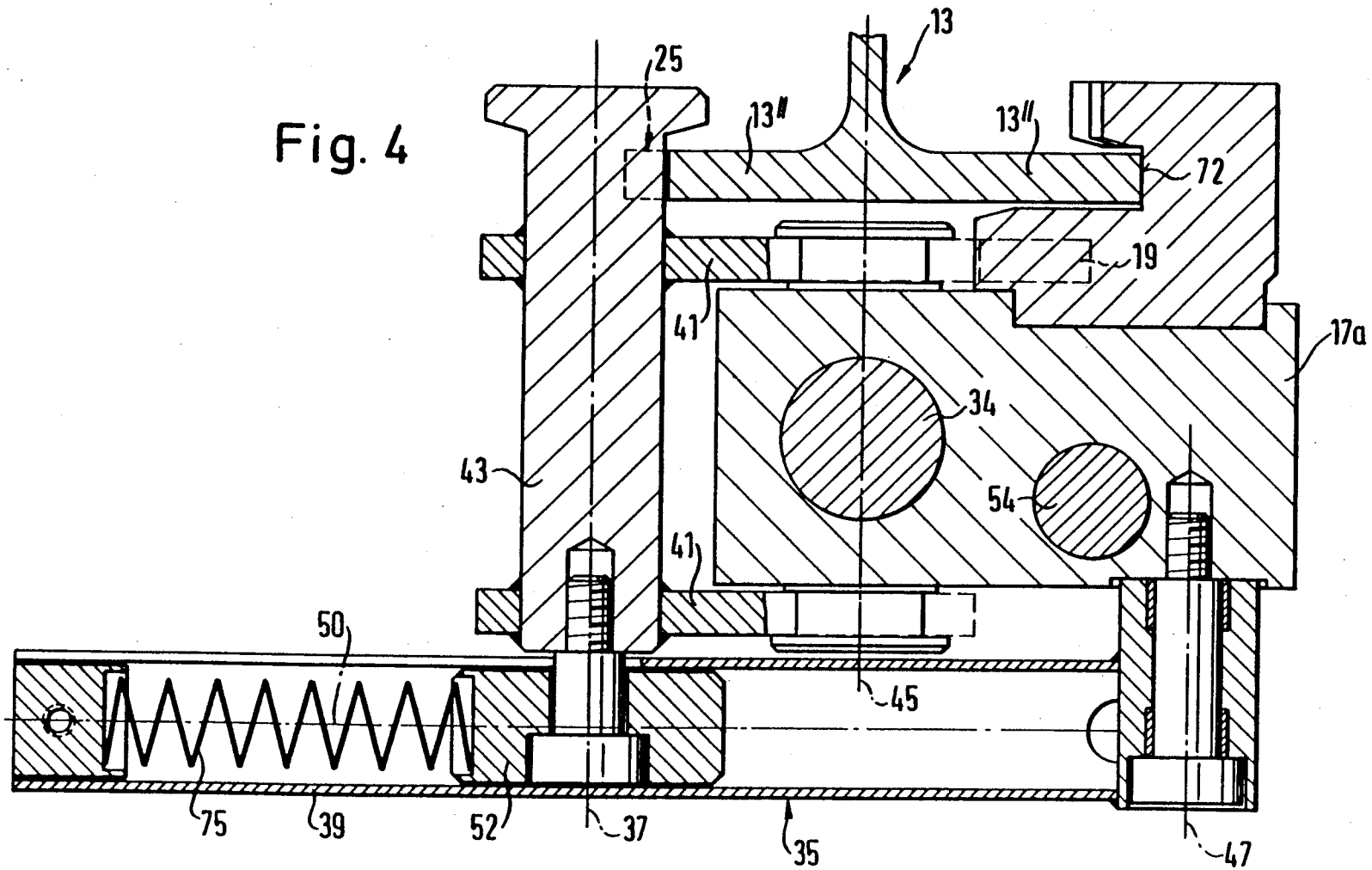
Figure 5:
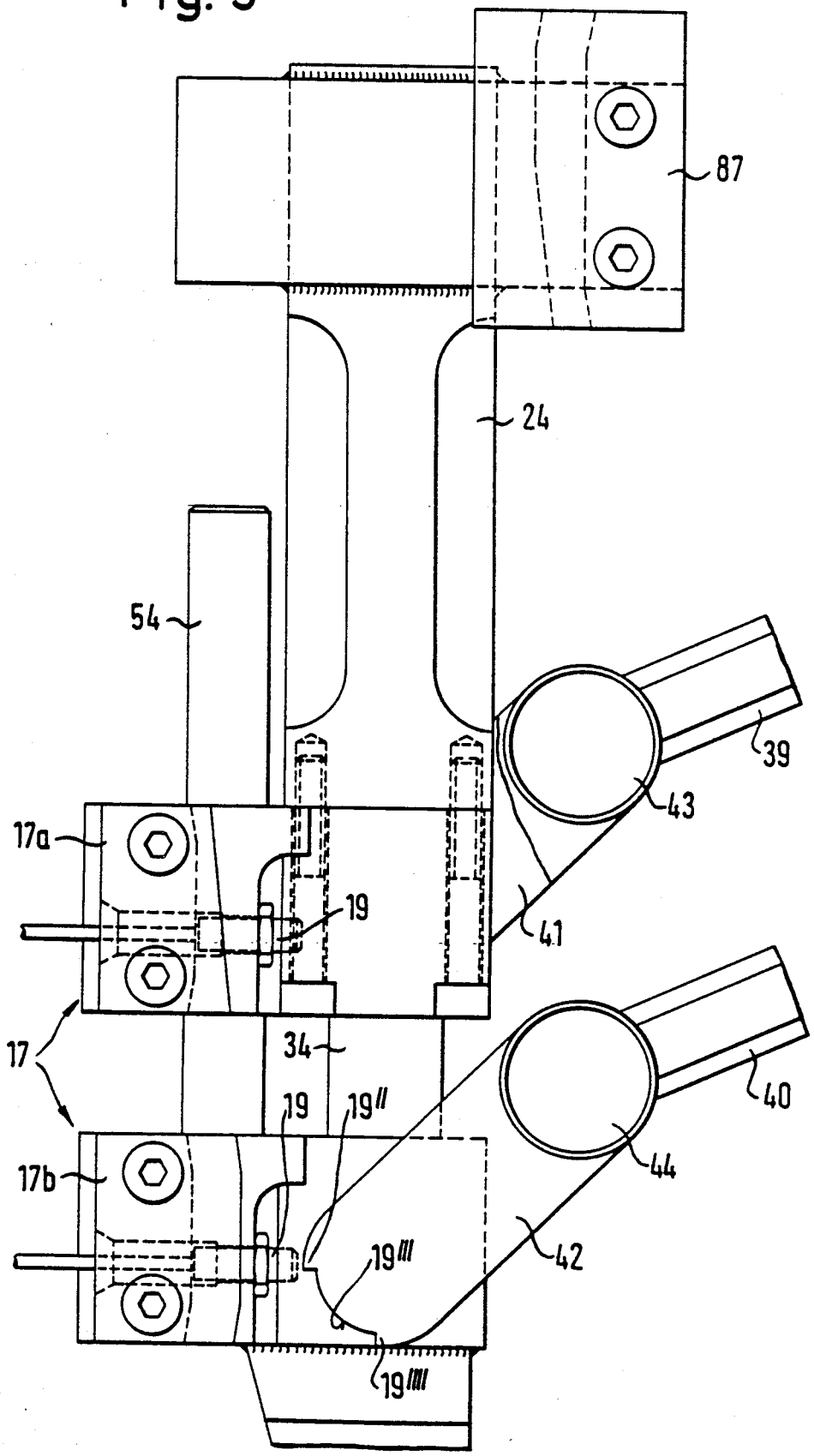
Figure 6:
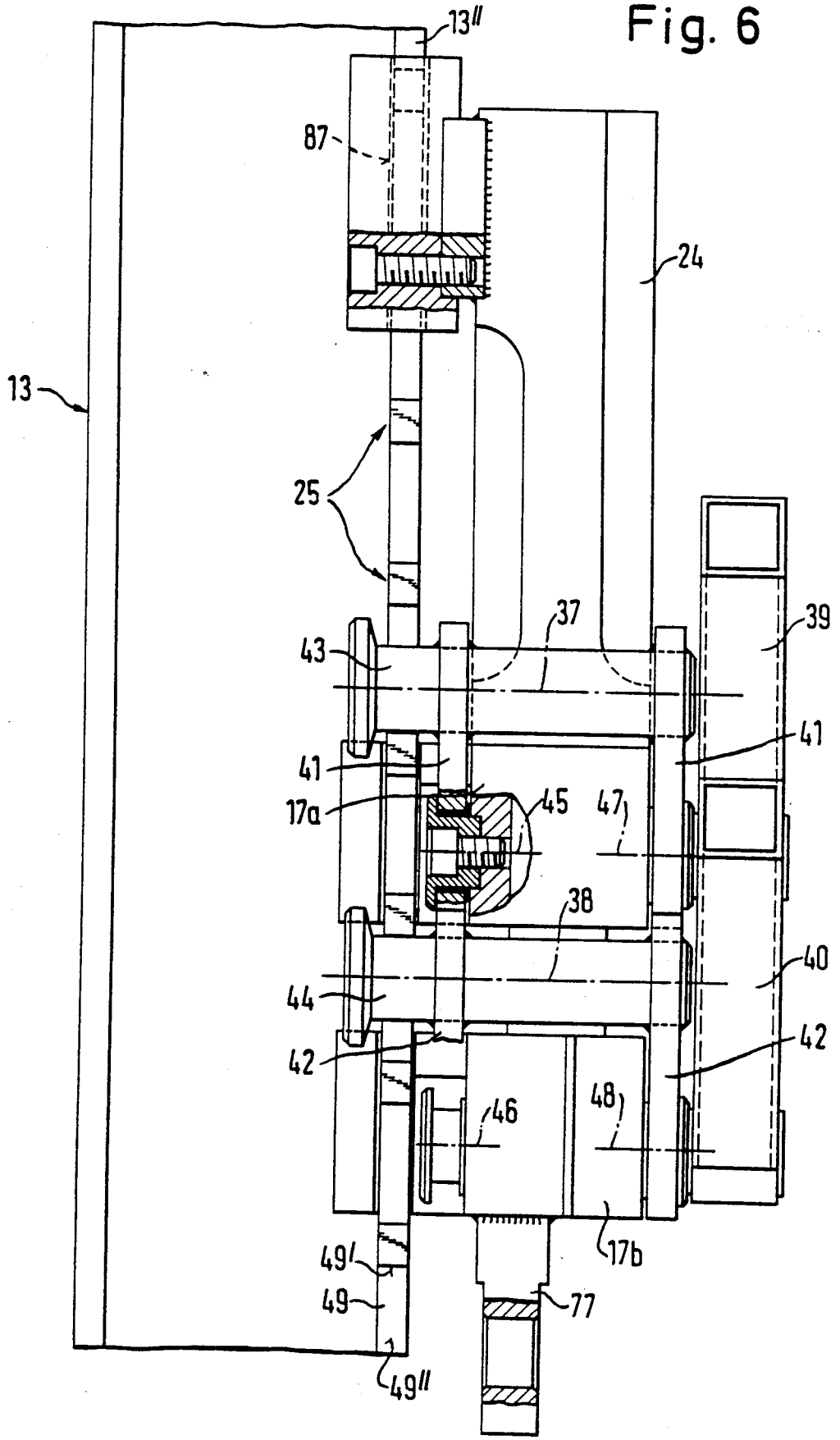
Figure 7:
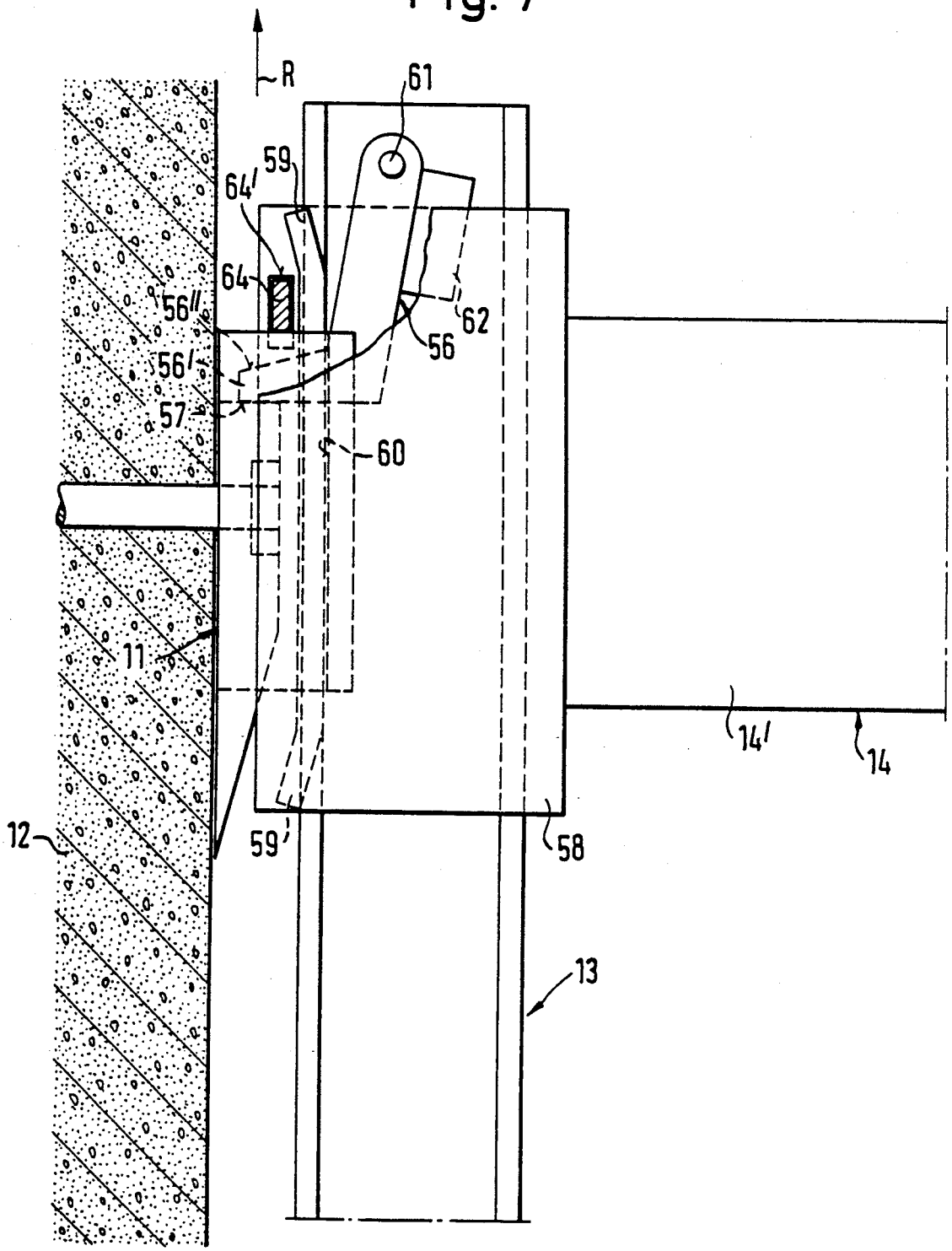
Figure 8:
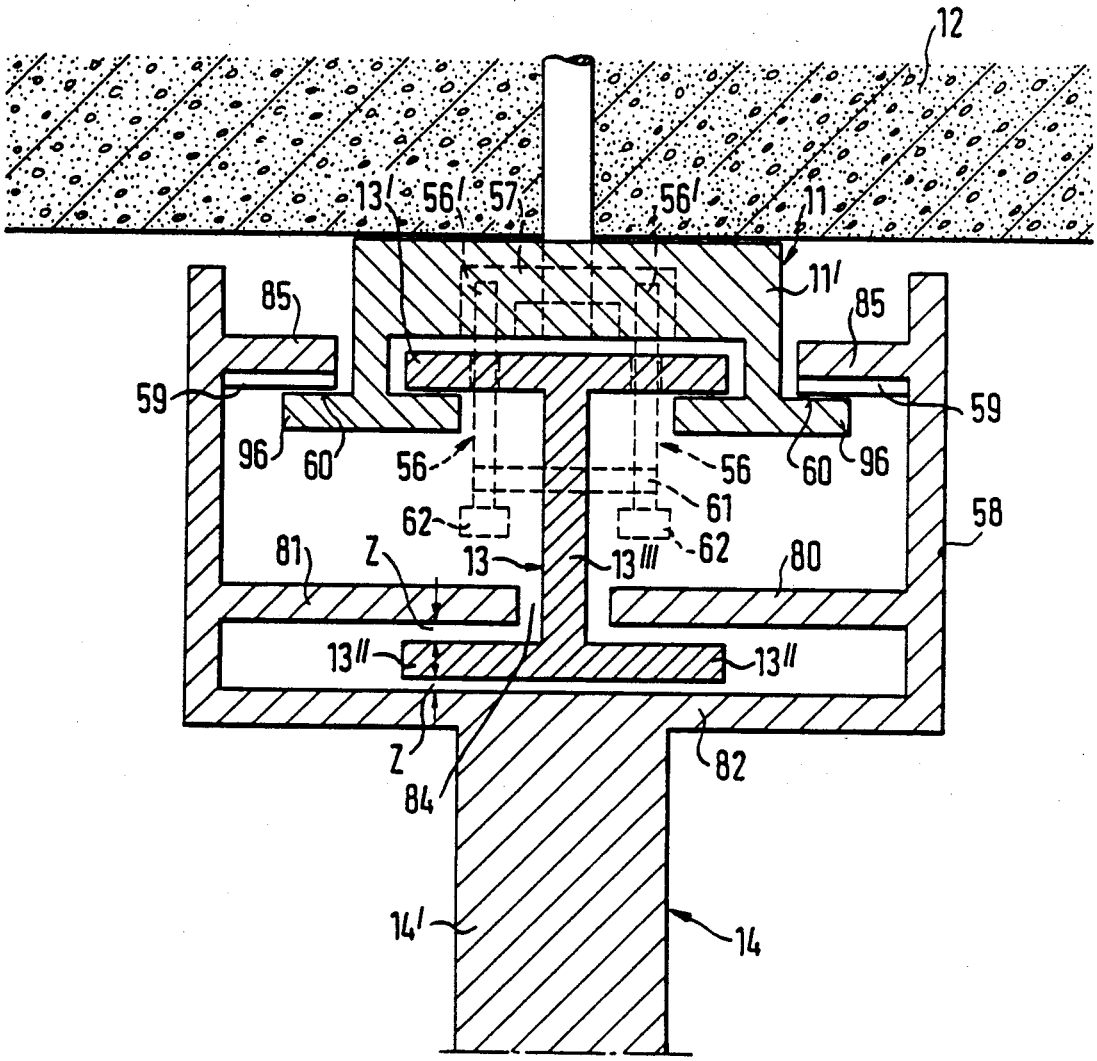

The invention will be described by way of example in the following with reference to the drawings in which are shown:

FIG. 1 a schematic sideview of a displaceable platform in accordance with the invention which is arranged at a vertical wall of a construction and which is provided with shuttering for the concreting of the wall, FIG. 2 a schematic view of the displaceable platform of FIG. 1 in the direction of the arrow II in FIG. 1, with the actuation and control elements being additionally reproduced in the manner of a block-ciruit diagramm, FIG. 2*a* a preferred practical embodiment of the pressure source of FIG. 2 which is capable of being changed over, FIG. 3 a partly sectioned and enlarged sideview of the displacement mechanism 17 shown in FIGS. 1 and 2, FIG. 4 a section on the line IV—IV in FIG. 3, FIG. 5 a view of the subject of FIG. 3 from the opposite side without illustration of the carrier rail, FIG. 6 a partly sectioned view of the subject of FIG. 3 in the direction of the arrow VI in FIG. 3, FIG. 7 an enlarged section from FIG. 1 in the region of a slidable guide shoe which is pushed onto a support shoe, and FIG. 8 a schematic horizontal section of the subject of FIG. 7.

In all figures the same reference numerals are used to designate components which correspond to one another.

In FIG. 1 a displaceable platform for climbing shuttering in accordance with the invention has support shoes 11 which are secured to the already concreted part of a wall 12 at an interval above one another. In accordance with FIG. 8 the support shoes have a substantially C-shaped displacement guiding space 11'. The webs 13' of a carrier rail 13 which are substantially complementary in shape to the space 11' engage within this guide space. In accordance with FIGS. 1, 7 and 8 the central web 13''' of the carrier rail carries carrying cams 56 which are pivotable about a transverse axis 61 which extends parallel to the wall 12. The carrying cams are provided with counterweights 62 at the side of the transverse axis 61 remote from the wall 12, as a result of which carrier cams are biased into their rail carrying position which can be seen in FIGS. 1 and 7. In the carrying position which can be seen from FIGS. 1, 7 and 8 a lower projection 56' of the carrier cam which is directed towards the wall 12 lies on an upper support surface 57 of the support shoe 11. The projections 56' extend through correspondingly dimensioned openings 63 (shown in broken lines in FIG. 8) of the webs 13' of the carrier rail 13.

If the carrier rail 13 is displaced upwardly out of the position which can be seen from FIGS. 1, 7 and 8 relative to the support shoe 11 then the carrier cams 56 can pivot in the direction away from the wall as a result of the oblique edges 56'' (FIG. 7) which are provided at the top on the projection 56', with the oblique edges 56'' sliding along a locking bar 64 which will be described in detail later and which extends parallel to the wall 12. The locking bar holds a slidable guide shoe to which a displaceable bracket arrangement 14 is secured during the upward displacement of the carrying rail 13 at the support shoe 11.

A spreading spindle 65 is arranged between the two support shoes at the top and the two support shoes at the bottom between the wall 12 and the lower end of the displaceable bracket arrangement 14 and serves to bear the component of weight of the displaceable bracket 14 which is directed towards the wall 12 when pushing the carrier rails 13 upwardly.

The displaceable bracket arrangement comprises horizontal beams or a horizontal platform 14' which is journalled at its end directed towards the wall 12 via a slidable guide shoe 58 on the carrier rail 13 or on the support shoe 11 (FIGS. 1, 7 and 8). Supports 14'' which extend obliquely downwardly from the platform 14' in the direction towards the wall 12 are provided at a distance from the wall 12. In addition, vertical supports 14''' are also provided close to the wall between the platform 14' and the lower end of the oblique struts 14''. Horizontal struts 14'''' complete the displaceable bracket arrangement.

A scaffold 14*a* can be suspended beneath the bracket arrangement 14.

The lower end 14*b* of the displaceable bracket arrangement 14 is connected via a carrier member 14*c* which is directed towards the wall with a displacement or climbing mechanism 17. This climbing mechanism cooperates with a toothed displacement rack 25 provided in the left hand side web 13'' (FIG. 8) of the carrier rail 13 which is directed away from the wall, and indeed in the sense that the displacement mechanism 17 works itself upwardly stepwise on the carrier rail 13 as a result of a linear drive 15 provided in the displacement mechanism.

The upward movement of the displacement mechanism begins in the region of the lower end of the carrier rail 13 as shown in FIG. 1 and finishes directly above the climbing mechanism 17 illustrated in FIG. 1. The displacement mechanism 17 is described further below in detail with reference to FIGS. 3 to 6.

On the platform 14' of the displaceable bracket arrangement 14 there is provided a vertical shuttering 66 suitable for the concreting of the wall 12. The shuttering skin 67 of the vertical shuttering 66 can be brought through the adjustment elements 68, 69 which can be seen in FIG. 1 into the desired position relative to the already concreted section of the wall 12.

As seen in FIG. 2 numerous carrying rails 13, in the present embodiment three such carrying rails 13, together with the slidable guide shoes and displacement mechanisms 17 arranged thereon, are provided for the vertically displaceable support of a displaceable bracket arrangement 14. In FIG. 2 a concreted section is designated by L. By displacement of the bracket arrangement 14 from the lower end of the carrier rail 13 to the upper end of the carrier rail 13 the shuttering advances by the length L of a concreting section.

As seen in FIG. 2 each displacement mechanism 17 has a linear drive 15 in the form of a double acting hydraulic cylinder 24 containing a piston 23, with the two pressure chambers of the hydraulic cylinder 24 being connected via hydraulic lines 26 and 27 respectively to hydraulic feeder lines 28, 29. The individual hydraulic lines 26 and 27 which respectively lead to the linear drives 15 branch off from the feeder lines 28, 29. The feeder lines 28, 29 are connected to a pressure source 30 which is capable of being switched over and which is located within a drive and control apparatus 22. The switchable pressure source 30 is driven by a motor 18 which is connected to a switching device 21 contained within the drive and control apparatus. The switching device can be switched on from the outside via a switch 70 whereupon the motor 18 starts and, depending on the direction of the motor 18 the pressure source 30 pressurizes the feeder line 28 or the feeder line 29 with hydraulic pressure. Accordingly, all the pistons 23 in the individual linear drives 15 move simultaneously in the one or other direction. The pressure source 30 which is capable of being switched over can for example consist of a pump and attached multi-way valves which are switched by the switching device in the sense of the desired changeover of the pressure.

FIG. 2*a* shows a practical embodiment for the pressure source which is capable of being changed over. In accordance with this embodiment a pump 88 which is driven by an electric motor 18 and the suction side of which is connected to a container 89 filled with hydraulic fluid is connected to a three position two-way valve 90. The other input of the two-way valve 90 is connected to the container 89. The hydraulic feeder lines 28 and 29 respectively are disposed at the output of the two-way valve 90. In the central position of the two-way valve shown in FIG. 2*a* the connections between the pump 88 and the container 89 to the feeder lines 28, 29 are interrupted. In the right position the output of the pump 88 is applied to the feeder line 28 while the feeder line 29 is connected to the container 89. On switching over the two-way valve to the left hand position the connections are reversed so that pressure is now applied to the feeder line 29 and the feeder line 28 is applied to the container 89.

The two-way valve 90 is connected by means of a control line 86, which is indicated in broken lines to the switching device 21 which controls the particular positions of the two-way valve 90 which are required and which are initiated by the pressure switches 32, 33 and also the hand switch 70. When the switch 70 is located in the off-position the two-way valve 90 is located in the central position, whereas it switches to and fro between the two end positions after switching on of the switch 70. The control will now be described in the following in detail.

The movement of the piston 23 is restricted in both directions by the abutments 16 and 32 which are schematically illustrated in FIG. 2.

Pressure switches 32 and 33 are connected to the feeder lines 28 and 29 respectively within the drive and control apparatus 22 and act on the switching device 21 in the sense that switching of the pressure source 30 takes place when a sudden pressure rise occurs in the associated line 28 or 29, such as arises when all the pistons 23 of all the attached linear drives 15 contact the abutment 16 or 31. Thus, if for example a sudden rise in pressure is determined in the feeder line 28, and if the pressure switch 32 is actuated thereby, then the switching device 21 (FIG. 2) switches the two-way valve 90 out of the right hand end position in which the pump 88 is connected to the feeder line 28, into the left hand end position so that now the feeder line 29 is connected with the pump 28 whereas the feeder line 28 is connected to the container. Following this the pistons 23 in all linear drives 15 move in the opposite direction until they contact the other abutment 31 whereupon a sudden pressure rise again occurs in the associated feeder line 29 which triggers the pressure switch 33 associated there with the and thereby causes a renewed change over or switching of the pressure source 30.

It is important that the change-over of the pressure 30 can only take place when all the pistons 23 have reached the prescribed end position. In this manner it is ensured that a change-over of the individual linear drives 15 does not take place too early, but rather only then when all the pistons 23 are located in the orderly end position.

For safety reasons at least one path transducer 19 is also arranged in each displacement mechanism 17, responds to the displacement of the displacement mechanism 17 relative to the carrier rail 13 and transmits a corresponding signal via the associated line 19' to an advance detector within the drive and control apparatus 22. A specially preferred embodiment of this path transducer will be described further below with reference to FIGS. 4 and 5.

When the individual displacement mechanisms 17 climb upwardly stepwise on the carrier rail 13 then each path transducer 19 indicates to the advance detector 20 when a displacement of the associated displacement mechanism 17 has taken place by one tooth of the toothed displacement rack 25.

The advance detector forms an output signal from the input signals of all the path transducers 19 which is likewise applied to the switching device 21 via a line 71. The output signal blocks the change-over in the switching device 21 when one or more of the path transducers 19 has still not indicated an advance of the associated displacement mechanism 17 by one tooth. In this manner it is additionally possible to prevent some of the displacement mechanisms 17 climb on further when one or more of the remaining displacement mechanisms has stuck.

The additional securing of the uniform advance of all displacement mechanisms 17 by the path transducers 19 is important because a sudden pressure rise in one of the feeder lines 28 or 29 can also take place when some form of jamming occurs within the displacement mechanism which blocks the linear drive 15 before the piston 23 has contacted one of the abutments 16, 31.

Each displacement mechanism climbs upwardly by one tooth on the toothed displacement rack 25 of the carrier rail 13 for each to and fro working movement of the piston 23 between the abutments 16 and 31.

In this manner each displacement mechanism 17 always only executes small stroke steps S. In this way it is ensured, in conjunction with the described electrical and hydraulic circuit, that on sticking of one of the displacement mechanisms 17, or of one slidable guide shoe 58, the remaining displacement mechanism 17 can complete at most one step S whereupon no change-over of the pressure source 30 can any longer take place because of sticking of the displacement mechanism 17. A further stroke of the displaceable bracket arrangement 14 is prevented until the disturbance has been alleviated. It is thus straightforwardly possible for the displaceable platform of the invention to be actuated by a single operator, and indeed even then when all the carrier rails 13 cannot be viewed from the position of the drive and the control mechanism 22, for example with a round construction. The working platform controls itself and stops automatically when the further displacement is hindered at one of the carrier rails 13, so that the fault can then be cured in a suitable manner.

As seen in FIGS. 3 to 6 each displacement mechanism 17 consists of two slide shoes **17*a* and 17*b* which are guided by means of the webs 13'' remote from the wall and which arranged spaced from one another by a vertical distance corresponding to the pitch of the toothed displacement rack 25. The one web 13'' of the carrier rail 13 engages in accordance with FIG. 4 into a guide groove 72 of each slide shoe while the toothed displacement rack 25 is arranged at the outer edge of the other web 13''. The toothed displacement rack 25 has tooth recesses 49 at regular intervals which, in accordance with FIG. 3 have right cylindrical regions 49' extending over approximately a quarter of the circle at the top and at the bottom and a straight region 49'' therebetween which extends parallel to the carrier rail 13**.

A circular guide bar 54 extends upwardly from the lower the lower slide shoe **17*b*, parallel to the carrier rail 13, passes through a vertical guide bore 55 in the upper slide shoe 17*a* and projects upwardly beyond the upper slide shoe 17*a* sufficiently far that the two slide shoes 17*a*, 17*b* are secured rotationally relative to one another in each relative displacement position. A double toggle lever 41, 42 is pivotally arranged about a toggle lever axis 45, 46 on each slide shoe 17*a*, 17*b*, in each case approximately at the center of the carrier rail 13. The toggle lever axis 45 stands perpendicular to the webs 13'' of the carrier rail 13. The toggle lever 41, 42 extends sideways up to the toothed displacement rack 25 and carries there, between its two parts 41 (FIG. 4) a carrying spigot 43, 44 of right cylindrical form which has the same diameter as the quarter circular edges 49' of the tooth recesses 49. The length of the double toggle levers 41, 42 respectively is such that, with a pivotal position of the toggle lever 41, 42 of the order of magnitude of 45° to the longitudinal extent of the carrier rail 13, the carrying spigots 43, 44 can engage with the tooth recesses 49 in such a way that one of the carrier spigots 43 or 44 carries the associated slide shoe 17***a* or 17*b* via the associated toggle lever 41 or 42 respectively. The double acting hydraulic cylinder 24 containing the piston 23 is accommodated on the upper slide shoe 17*a*. A piston rod 34 extends downwardly from the piston 23 and emerges at the botton sealingly and slidingly out of the hydraulic cylinder 24 and also out of the upper slide shoe 17*a* and is fixedly connected with the lower slide shoe 17*b*. In this manner the slide shoes 17*a*, 17*b* can be moved away from one another by pressurizing the upper pressure chamber 73 of the hydraulic cylinder 24 and can be moved towards one another by pressurizing the lower pressure chamber 74.

Pivot levers 39 and 40 are furthermore connected to the slide shoe 17*a*, 17*b* respectively at a distance A remote from the toothed displacement rack 25 about pivot lever axes 47, 48 which extend parallel to the toggle lever axes 45, 46 and likewise extend in the direction of the toothed displacement rack 25, but project however substantially beyond the ends of the toggle levers 41, 42 at the toothed displacement rack. Pressure springs 75 and 76 are accommodated in the end regions of the pivot levers 39, 40 respectively. These pressure springs load respective slide elements 52 and 53 which are present within the pivot levers 39, 40 at the level of the free ends of the toggle levers 41, 42. The slide elements 52, 53 are aligned with the carrier spigots 43, 44 and also pivotally connected to the latter. The slide elements 52, 53 are axially slidably guided along the respective longitudinal axes 50 and 51 of the pivot levers 39, 40.

As seen in FIG. 4 each pivot lever 39, 40 lies in plan view alongside the double toggle levers 41, 42.

Each pivot lever 39, 40 forms, together with the associated toggle levers 41, 42 a toggle lever arrangement 35 and 36 respectively.

A possible constructional arrangement for the path transducer 19, which can in particular be executed as an inductive transducer, is set forth in FIGS. 4 and 5. The path transducers 19 are fixedly incorporated in the respective components of the slide shoes 17*a* and 17*b* in which the guide grooves 72 are provided. The path transducers 19 are located facing the toggle lever pivot axes 45, 46 at a small distance from the outer edge of the toggle levers 41 and 42 respectively. The upper toggle lever 41 in FIG. 4 has a radially projecting transducer cam 19' at its periphery as seen in FIG. 5 which, when it is arranged opposite to the transducer 19 in accordance with FIG. 5, transmits a release signal to the advance detector 20. The release signal is thus transmitted to the advance detector 20 each time the two the toggle levers 41, 42 are located in the upper position shown in FIGS. 3 and 5, where only the upper toggle lever 41 carries. If only one of the toggle levers moves downwardly then the peripheral cutout 19''' which can be seen from FIG. 5 comes into alignment with the path transducer 19 and the advance detector 20 receives a blocking signal, as a result of which the advance detector 20 makes a change-over of the pressure source 30 via the switching device 21 impossible.

The operation of the displacement mechanism described with reference to FIGS. 3 to 6 is as follows:

In the initial position illustrated in FIG. 3 the upper toggle lever 41 carries, via the associated carrier spigot 43 which is braced at the lower rounded portion of a tooth recess 49, the entire displacement mechanism 17 and the displaceable bracket arrangement 14 which engages with the lower side of the displacement mechanism at 77.

If the displacement mechanism 17 is now to be moved upwardly by one tooth then the pressure chamber 73 is pressurized via the hydraulic line 26 from the pressure source 30 (FIG. 2) whereupon the lower slide shoe 17*b* moves downwardly. This is possible because the toggle lever axes 45, 46 were arranged at a vertical distance from one another such that the lower carrying spigot 44 is braced against the upper rounded portion 49' of the second latch recess 49 following the upper carrier spigot 43 in the downward direction. The entire length of the straight edge 49'' of the tooth recess 49 is now available for a downward movement of the carrier spigot 44. This downward movement of the slide shoe 17*b* takes place until the carrier spigot 44 comes into contact with the lower quarter circle edge 49' of the associated tooth recess 49. The carrier spigot 44 now takes on the carrying function for the displacement mechanism 17 and the attached displaceable bracket arrangement 14 via the lower toggle lever 42 and the slide shoe 17*b*. As a result of the reaction force the upper slide shoe 17*a* now moves upwardly and indeed until the upper carrier spigot 43 comes into contact with the top quarter circular edge 49'. Nevertheless the upward movement of the upper slide shoe 17*a* is continued because the upper carrier spigot 43 can slide upwardly passed the tooth 78 with a slight downward pivoting of the upper toggle lever arrangement 35 until the upper carrier spigot snaps into the tooth recess which lies above it and comes into contact with its upper quarter circle edge 49'.

Both toggle levers 41, 42 now adopt the carrying position which is evident from FIGS. 3 and 5 in which the transducer cams 19'' lie opposite to the path transducers 19, or better the angular transducers, so that a release signal is transmitted to the advance detector 20. A further advance of the displacement mechanisms 17 is thus only possible when, after an advance by one tooth, all the toggle levers 41, 42 have again adopted their carrying position in accordance with FIGS. 3 and 5. A further advance is thus prevented when one of the carrier spigots 43, 44 has not latched in problemfree manner into the toothed displacement rack 25.

Finally the piston 23 comes into contact with the lower abutment 16 whereby a further upward movement of the slide shoe 17*a* is avoided. At the same time the pressure in the pressure chamber 73 rises and controls a switching device 21 via the hydraulic lines 26, 28 (FIG. 2) and also via the pressure switch 32, in such a way that the switching device changes over the pressure source 30 into the other pressure generating direction.

Pressure is now applied to the pressure chamber 74 of the hydraulic cylinder 24 via the line 27 (FIG. 3) whereby the hydraulic cylinder moves downwardly relative to the piston 23. In this way, since the displacement mechanism 17 is carried by the lower carrier spigot 44, the upper slide shoe 17*a* will move downwardly until its carrier spigot 43 comes into contact with the lower quarter circle edge 49' of the associated tooth recess 49 and bears the load. Following this, since the displacement mechanism 17 is now carried by the upper carrier spigot 43, the lower slide shoe 17*b* will move upwardly until its carrier spigot 44 comes into contact with the associated tooth recess 49 at the upper quarter circular edge 49'. The lower toggle lever arrangement 36 now moves resiliently downwardly until the carrier spigot 44 can move upwardly passed the tooth 79 and snap into the tooth recess 49 which is located above it in order to come into contact with its upper quarter circular edge 49'. At this instant the piston 23 pushes against the upper abutment 31 of the hydraulic cylinder 24 so that a sudden pressure built-up occurs in its lower pressure chamber 74, which in the above described manner again ensures a change over of the pressure source 30 (FIG. 2).

The displacement mechanism 17 has now been displaced further upwardly by one tooth and the described working sequence repeats itself periodically.

As seen in FIGS. 7 and 8 two guide walls 80, 81 of the slidable guide shoe 58 which guides the displaceable bracket arrangement 14 at the top and a rearwall 82 of the slidable guide shoe, which ensures the connection to the platform 14', engage around the webs 13''' of the carrier rail 13 remote from the wall 12, with the central web 13''' of the carrier rail 13 passing through a slot 84 located between the walls 80, 81. The slidable guide shoe 58 surrounds the webs 13'', 13''' with clear play, which is not however disturbing, since, when the slide guide shoe 58 is out of engagement with the support shoe 11, i.e. moves on the free part of the carrier rail 13, the walls 80, 81 contact the webs 13'' with a sliding seating through the weight of the displaceable bracket arrangement 14.

In the region of the support shoe 11 the guide slide shoe 58 has further support walls 85 which engage behind lateral projections 96 of the support shoe 11. In accordance with FIGS. 7 and 8 oblique surfaces 59 which are inclined somewhat towards the wall 12 are provided at the top and the bottom on the support walls 85, with the direction of inclination and the size of inclination being such when a slidable guide shoe 58 is pushed on along the carrier rail with the walls 81, 80 contacting the web 13'' of the carrier rail 13, the oblique surfaces 59 can enter into engagement with counter surfaces 60 at the lateral projections 96. On being pushed on further the slidable guide shoe 58 is drawn towards the wall by the oblique surfaces 59, whereby the walls 80, 81 lift-off from the webs 13'' and thus release the carrier rails 13 for effortless upward displacement of the same.

The lower oblique surfaces 59 (FIG. 7) are provided so that on pushing the slidable guide shoe 58 upwardly onto the support shoe from above, or on changing the loading from the support shoe 11 up to the carrier rail 13 on further climbing up to the next concreting section the loading changes from the carrier rail 13 onto the support shoe 11.

The locking bar 64 which can be seen from FIGS. 1 and 7 is pushed through suitable transverse openings 64' of the guide slide shoe 58 as soon as these transverse openings 64' are located sufficiently far above the upper support shoe 11 that space is present for the pushing through of the locking bar 64. The locking bar 64 is braced at the top on the support shoe 11 and thus takes over the carrying of the displaceable bracket arrangement as long as the carrier rail 13 is being pushed upwardly, and in the rest position during concreting.

When the carrier rail 13 is to be pushed upwardly, with the displaceable bracket arrangement 14 being anchored to the support shoes 11, then the toggle lever arrangement 35, 36 of FIG. 3 are pivoted downwardly manually into the positions 35', 36' which are indicated in broken lines so that they adopt a mirror-image arrangement with respect to a horizontal plane relative to the position illustrated in full lines in FIG. 3. The pressure source 30 which is capable of being changed over now again energizes the hydraulic cylinder in the manner which took place already during stepwise upward pushing of the displaceable bracket arrangement 14. The displacement mechanisms 17 are however now braced against the displaceable bracket arrangement 14 which is fixed to the support shoes 11 so that—as a result of the downwardly pivoted toggle lever arrangements 35',36'—the carrier rails 13 are lifted stepwise until they adopt the highest position in which the lower carrier spigot 44 is located at the end of the toothed displacement rack 25. It is thus important that the material of the carrier rail 13 is substantially flush with the tooth height at the end of the tooth displacement rack 25 so that the further stroke of the carrier rail 13 is prevented, since the transducer cam 19'''' (FIG. 5) of the lower toggle lever 42 is now no longer aligned with the path or angle transducer 19.

As soon as the rail 13 has been displaced into the next higher position and its upper end has been suspended in a support shoe 11 arranged there, the two toggle lever arrangements 35, 36 can again be pivoted upwardly into the position shown in full lines in FIG. 3, whereupon the displacement mechanism 17 is again prepared for the stepwise lifting of the displaceable bracket arrangement 14 in the next concreting section.

In accordance with FIGS. 3, 5 and 6 an additional slidable guide 87 can be provided at the upper end of hydraulic cylinder 24 at the side facing the carrier rail 13, with the slidable guide engaging around the web 13'' of the carrier rail 13 having the toothed displacement rack 25 and stabilizing the displacement movement of the displacement mechanism 17 on the carrier rail 13.

What is claimed is:

1. A displaceable platform which is moveable sectionwise on a wall, preferably upwardly, comprising:

support shoes (11) which are securable to the wall at specific intervals in the direction of movement;

at least two carrying rails which are arranged spaced apart alongside one another and which extend along the wall (12) between at least two support shoes (11); and at least one displaceable bracket arrangement (14) which is displaceable in the direction of movement and is securably arranged on at least two of said carrier rails (13), said carrier rails arranged alongside one another, wherein, the carrier rails (13) are first fixed to the support shoes (11), said support shoes being secured to the wall (12) and defining a first section, the displaceable bracket arrangement (14) is displaced along the carrier rails (13) within said first section by means of a linear drive means, said carrier rails (13) capable of being released from the support shoes (11) to advance said rails and said bracket by a one section increment to a second section wherein said rails are then once again fixed to further support shoes (11) secured to the wall (12), whereupon the sequence of working is repeated; said linear drive means comprised of a linear drive (15) attached to each of said carrier rails (13) to advance the displaceable bracket arrangement (14) within the section in small incremental steps to allow non-uniform displacements of adjacent linear drives (15) as said adjacent linear drives advance through a section; wherein all said linear drives (15) are jointly driven and controlled from a common drive and control apparatus (22) in such a way that said linear drive means advance through a section in an orderly fashion.

2. The displaceable platform of claim 1 further comprising at least one path transducer (19) of each of said carrier rails, said path transducers being connected with an advance detector (20) for determining the relative step rate difference of neighboring linear drives (15); said advance detector (20), on finding the maximum permissible step difference between adjacent linear drives (15) switching off all linear drives (15) via a switching device (21), or permitting the next working step advancement of the displacement mechanism (17) when said displacement mechanisms are progressing in an orderly manner.

3. The displaceable platform of claim 1, wherein said linear drive means is formed as a displacement mechanism by mounting the linear drive (15) on the displacement element, which is displaceably arranged on the carrier rail (13) and which carries the displaceable bracket arrangement (14), with the linear drive acting between the carrier rail (13) and the displacement element.

4. The displaceable platform of claim 3, further comprising a toothed displacement rack disposed on the carrier rail, said displacement rack having a plurality of teeth and extending in the direction of displacement and defining the steps, with the linear drive (15) and the displacement mechanism (17) being braced against the toothed displacement rack; said linear drive (15) executing a stepwise displacement movement or climbing movement in accordance with the toothed displacement rack (25) and advancing the displacement mechanism (17) by one tooth for each step.

5. The displaceable platform of claim 4, wherein the linear drive (15) is formed by a double acting hydraulic cylinder (24) provided with a piston (23).

6. The displaceable platform of claim 5, wherein said hydraulic cylinder has a plurality of pressure chambers that are switchably connected via hydraulic lines (26, 27, 28, 29) to a pressure source (30), to allow selective switching of the pressure source between pressure chambers, said selective switching being dependent upon the location of said piston within each linear drive.

7. The displaceable platform of claim 6, wherein each hydraulic cylinder (24) is provided with two abutments to restrict travel of said piston, and having a pressure (32, 33) connected to each hydraulic line (26, 27 and 28, 29 respectively), to initiate via the switching device (21) a change-over of the pressure supplied by the pressure source (30) when, after movement of all pistons (23) against the abutments (16 and 31, respectively), the relevant pressure switch (32 or 33, respectively) registers a sudden pressure rise caused thereby.

8. The displaceable platform of claim 5, wherein the displacement mechanism (17) is comprised of a first and second slide shoe (17*a*, 27*b*) slidably arranged in series on the carrier rail (13), said piston (23) having a piston rod (34) which is slidably connected to said first slide shoe and fixedly connected to said second slide shoe.

9. The displaceable platform of claim 8, further comprising a toggle lever (41, 42) pivotally attached to each of said slide shoes (17*a*, 17*b*) via a toggle lever axle (45, 46) disposed perpendicular to the carrier rail (13) and extending from the toggle lever axle (45, 46) to the toothed displacement rack (25), and a carrier spigot (43, 44) extending from the toggle lever (41, 42) perpendicular to the plane of pivoting and parallel to the toggle lever axle (45, 46) the carrier spigot having a complementary shape to the toothed recesses (49) of the toothed displacement rack (25) and standing out of engagement with the toothed displacement rack (25) when the toggle lever (41, 42) is perpendicular to the longitudinal axis of the carrier rail (13), said carrier spigot standing in engagement with the toothed displacement rack (25) when pivoted relative to the longitudinal axis of the carrier rail at an angle substantially less than 90°; said tooth recesses (49) configured such that when one carrier spigot (43, 44) is selectively brought by a relative displacement of the slide shoes (17*a*, 17*b*) into a load carrying engagement with the toothed displacement rack (25) opposite to the displacement direction, the corresponding carrier spigot is respectively relieved when brought by displacement of the associated slide shoe (17*a*, 17*b*) and thereby can be positioned into the next tooth recess (49) in the displacement direction.

10. The displaceable platform of claim 9, wherein each slide shoe (17*a*, 17*b*) carries an overlapping toggle lever arrangement (35, 36) comprising of a pivot lever (39, 40) and the toggle lever (41, 42); such that the pivot lever (39, 40) is likewise pivotally journalled on the slide shoe (17*a*, 17*b*) about a pivot lever axle (47, 48) which extends parallel to the toggle lever axle (45, 46) and is spaced therefrom; each said pivot lever (39, 40) containing a sliding member (52, 53) which slides along its longitudinal axis (50, 51) and is aligned with the toggle lever axle (37, 38), which coincides with the axis of the carrier spigot (43, 44) and which is pivotally connected to the carrier spigot (43, 44), and to the toggle lever (41, 42) about the toggle lever axle (37, 38).

11. The displaceable platform of claim 10, wherein the sliding member (52, 53) can be urged by a resilient force in the direction of the pivot lever axle (47, 49).

12. The displaceable platform in accordance with claim 10, wherein the device is structured such that an imaginary line connecting between the toggle lever axle (45, 46) and the pivot lever axle (47, 48) would stand perpendicular to the longitudinal axis of the toothed displacement rack (25) and the longitudinal axis of the carrier rail (13).

13. The displacement platform of claim 10, characterized in that the pivot lever axle (47, 48) is further removed from the toothed displacement rack (25) than the toggle lever axle (45, 46).

14. The displaceable platform of claim 8, further comprising a guide bar (54) positioned parallel to the carrier rail (13) and extending from the first slide shoe (17*b*) through a guide bore (55) of the second slide shoe (17*a*).

15. The displaceable platform of claim 3, characterized in that the lower end of the displaceable bracket arrangement (14) is connected to the displacement mechanism (17).

16. The displaceable platform of claim 2, further comprising a plurality of toggle levers and corresponding carrier spigots arranged near a toothed displacement rack having tooth recesses, wherein a path transducer (19) is associated with each toggle lever (41, 42) in such a way that an advance release signal is transmitted from the path transducer (19) to the advanced detector (20)

only when the associated toggle lever (41 or 42, respectively) is located in a pivotal position (FIG. 3) where the carrier spigot (43 or 44, respectively) arranged on the toggle lever is latched into the tooth recesses (49) of the toothed displacement rack (25).

17. The displaceable platform, of claim 1, characterized in that the carrier rail (13) has an upper end region and comprises a carrier cam at said upper end region which is pivotable towards the wall (12) and suspended on a hinge (61), with the carrier cam (56) being able to enter into carrying engagement with a carrying surface (57) of a support shoe (11) when in a state pivoted towards the wall (12) said carrier cam being able to move past the support shoe (11) on displacement of the carrier rail (13) when in the state pivoted away from the wall (12).

18. The displaceable platform in accordance with claim 17, characterized in that a resetting force acts on the carrier cam (56) and biases it towards the wall.

19. The displaceable platform of claim 1, characterized in that a slidable guide shoe (58) arranged at a distance from the displacement mechanism (17) in the direction of displacement, preferably at the top on the displaceable bracket arrangement (14) and is slidingly arranged on the carrier rail (13) having a specific play (5) in the displacement direction to the wall, and in the displacement direction to the support shoe (11) which is secured to the wall (12), said guide shoe having oblique surfaces (59) which are slightly inclined relative to the direction of displacement (R) and which cooperate with countersurfaces (60) of the support shoe (11), or of the slidable guide shoe (58) respectively, in such a way that upon pushing the slidable guide shoe (58) onto a support shoe (11), the inclined surfaces (59) and the countersurfaces (60) enter into engagement and the slidable guide shoe (58) is brought out of sliding engagement with the carrier rail (13).

20. The displaceable platform of claim 10, characterized in that the toggle lever arrangement (35, 36) can be folded over into the opposite direction into a mirror image position; wherein when said toggle lever is in said mirror image position, after securing the displaceable bracket arrangement (14) directly to the support shoes (11) and releasing the carrier rail (13) from the slidable guide shoe (58), the guide rail can be displaced upwardly in steps to the next concreting level by actuation of the switchable pressure source (30).

* * * * *